US005218745A

United States Patent [19]

Hollis et al.

[11] Patent Number: 5,218,745

[45] Date of Patent: Jun. 15, 1993

[54] SCUBA TANK STRAP TIGHTENING ACTUATOR

[76] Inventors: Robert Hollis, 14275 Catalina St., San Leandro, Calif. 94577; William D. Walters, 2230 Biscay Ct., Byron, Calif. 94514

[21] Appl. No.: 755,641

[22] Filed: Sep. 6, 1991

Related U.S. Application Data

[63] Continuation-in-part of Ser. No. 592,674, Oct. 3, 1990, abandoned.

[51] Int. Cl.[5] ..... A44B 21/00

[52] U.S. Cl. ..... 24/483; 24/68 R; 24/268

[58] Field of Search ..... 24/603, 25, 268, 136 R, 24/463, 467, 483, 484, 68 R

[56] References Cited

U.S. PATENT DOCUMENTS

| | | | |
|---|---|---|---|
| 22,369 | 12/1858 | Jeffery | 24/25 |
| 684,835 | 10/1901 | Littel | 24/268 |
| 3,891,131 | 6/1978 | Tabata | 24/484 X |

FOREIGN PATENT DOCUMENTS

| | | | |
|---|---|---|---|
| 531816 | 1/1941 | United Kingdom | 24/483 |

*Primary Examiner*—James R. Brittain
*Attorney, Agent, or Firm*—Bruce & McCoy

[57] ABSTRACT

A tank strap tightening actuator for securing a SCUBA air tank to a diver's backpack by means of a strap which engages the backpack and surrounds the tank with the two free ends of the strap being hooked to said actuator around said tank, said actuator being activated by compressed air to tighten the strap.

6 Claims, 3 Drawing Sheets

SCUBA TANK STRAP TIGHTENING ACTUATOR

CROSS REFERENCE TO RELATED APPLICATION

This application is a continuation-in-part application to U.S. patent application Ser. No. 07/592,674 for SCUBA TANK STRAP TIGHTENER ACTUATOR filed Oct. 3, 1990 abandoned.

BACKGROUND OF THE INVENTION

1. Field of the Invention

The present invention relates to a SCUBA (self-contained underwater breathing apparatus) air tank strap tightening actuator, and more particularly, to a tightening actuator for securing a SCUBA diver's air tank to his or her backpack or buoyancy compensator (BC) by means of a strap which engages the backpack or BC and surrounds the tank with the two free ends of the strap being hooked to said actuator around said tank.

2. Description of the Prior Art

SCUBA tank securing straps for attaching the air tank to a diver's backpack have in the past used tank strap locking clamps such as were used for early automotive and aircraft seat belts. The free end of the belt is fitted through a clamp which, when it is closed, rotates a spiral ramp to narrow the gap in the belt track of the clamp to engage the belt between the ramp and the flat in the track. The ramp has a roughened surface which bites into the belt to prevent it from pulling out of the clamp. In order to release the belt, it must be pulled slightly tighter to allow the ramp to rotate out of engagement with the belt whereby the belt can then be pulled out of the clamp.

These belt tightening clamps, although they have been used for many years by SCUBA divers, are unsatisfactory for the reason that they cannot be fully tightened and they stretch to some degree when they get wet. A seat belt type of clamp cannot be fully tightened because the final clamping requires a pull on the belt in the loosening direction to set the clamp. This action loosens the belt slightly from its tightest position, and this slight loosening is very detrimental in this application because the strap is so short that the least loosening of it is a very significant percentage of elongation, and such a strap also requires considerable force to tighten it because it has very little stretch when it is dry.

This type of strap cannot be tightened after the diver goes underwater, where it stretches when it gets wet, because of its operative location high on the diver's back. There has long been a need for a new way to tighten these straps. Pre-wetting the strap to take out the stretch has not proved to be a solution since it takes too long to do, and it usually means disassembling the backpack to get the strap free whereby it can be conveniently submerged to get it wet. Therefore, a means has long been needed to put considerable force in the strap to remove any stretch and thereby tighten the strap securely around the tank and to secure the tank to the backpack of the SCUBA diver before he enters the water where the strap might stretch slightly and which will automatically take any stretch out of the strap if it occurs.

SUMMARY OF THE INVENTION

The present invention is a tank strap tightening actuator for securing a SCUBA air tank to a diver's backpack, or alternatively directly to a buoyancy compensator, by means of a flexible strap which engages the backpack and surrounds the tank with the two ends of the strap being hooked to said actuator around the tank. The actuator includes a mechanism having a body portion having a concave surface formed along one side thereof for mating with the cylindrical surface of an air tank. A first means is provided on the body portion of the actuator for engaging the strap proximate to one end thereof. A moveable block is mounted on the body portion and formed to reciprocate along a surface disposed on the opposite side of the body portion from the concave surface. A second strap engaging means is provided for securing the other end of the strap to the body portion at position relative to the movable block whereby movement of the block tightens the strap around the air tank and against the diver's backpack. An actuator means is provided on the body portion for moving the block until the strap is tightened. In the preferred form, this actuator includes an air actuated cylinder which obtains high pressure compressed air from the diver's air tank to actuate the mechanism.

OBJECTS OF THE INVENTION

It is therefore an important object of the present invention to provide a SCUBA air tank strap tightening actuator.

It is another object of the present invention to provide a tank strap tightening actuator for securing a SCUBA diver's air tank to a diver's backpack by means of a strap which engages the backpack and surrounds the tank with the two free ends of the strap being hooked to said actuator around said tank.

And it is a further object of the present invention to provide an actuator for tightening the strap around a SCUBA diver's air tank to secure it to the diver's backpack which is activated by compressed air from the SCUBA air tank.

Other objects and advantages of the present invention will become apparent when the apparatus of the present invention is considered in conjunction with the accompanying drawings.

DESCRIPTION OF THE DRAWINGS

FIG. 2 is an exploded perspective view of the SCUBA tank strap tightening actuator of the present invention in a retracted or non-actuated position with the ends of the strap disengaged from the actuator body;

DESCRIPTION OF THE PREFERRED EMBODIMENT

Reference is made to the drawings for a description of the preferred embodiment of the present invention wherein like reference numbers represent like elements on corresponding views.

Figure 1:
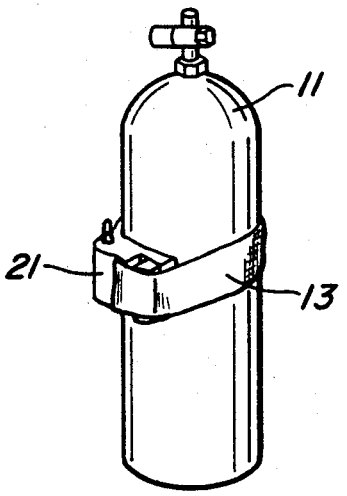
FIG. 1 is a perspective view of a SCUBA air tank with the tank strap tightening actuator secured to the strap which surrounds the tank and holds it to the diver's backpack.
Figure 5:
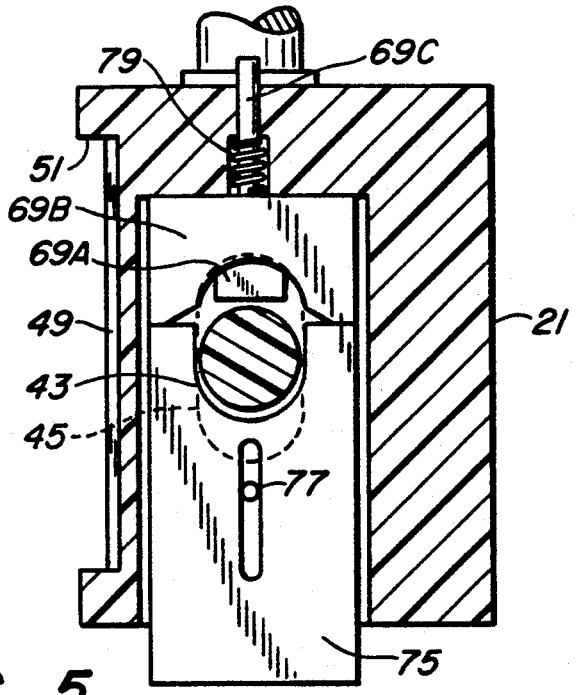
FIG. 5 is a cross-section taken along lines 5—5 of FIG. 4A.

The present invention illustrated in FIG. 1 is a tank strap tightening actuator for securing a SCUBA air tank 11 to a diver's backpack by means of a strap 13 which engages the backpack by being reeved through holes or slits which form belt loops in the back-pack. New designs of buoyancy compensators may eliminate the need for a backpack and the present invention can be utilized to secure the tank directly to the BC. The strap surrounds the tank with the two ends 15, 17 of the strap being hooked to the actuator around the tank. As the actuator 19 is activated, the strap is tightened around the tank thereby pulling it against the diver's backpack so that it stays in fixed position on the diver's back during a dive and prevents the tank from sliding out of position to hit the diver in the head or to slide down low on his back to hit him at the base of the spine or otherwise disturb his balance and stretch the air lines.

The main element of the invention illustrated in FIGS. 2-5 is the actuator mechanism which has a body portion 21 that has a concave surface 23 formed along one side thereof. The curvature of the concave surface is designed to conform to the cylindrical outer surface of a SCUBA air tank. Since most air tanks are of a standard diameter, but of different lengths for different air volumes, the concave surface of the actuator will conform to most regular sized air tanks. The body portion of the actuator can be constructed of molded or machined plastic or aluminum.

A first means is formed on the body portion 21 of the actuator for engaging the strap 13 which surrounds the air tank 11 proximate to one end thereof. In the simplest embodiment, one end of the strap can be wrapped around a cross-brace on the body portion and sewn to itself. In order for the strap to be made detachable from the body portion of the actuator, a loop can be sewn into the end of the strap and a removable cross pin inserted through the loop and the pin engaged to the body portion. This same structure can be utilized whereby the strap can be made adjustable with respect to length. This is accomplished by providing a pair of cross-braces on the actuator. The first cross-brace 25 is formed as an integral part of the actuator body portion at the end thereof to bridge a slot 27 formed in the concave surface 23 of the actuator. The slot is formed to receive the adjustable free end 15 of the strap whereby it is recessed in the concave surface when it is engaged to the actuator body portion under the first cross-brace and around the second.

This first end 15 of the strap 13 is engaged to the body portion 21 of the actuator by being folded over, and the doubled over end is then pushed under the first cross-brace 25 which is formed at the end of the actuator. A second cross-brace 29 in the form of a pin is inserted through the folded over end of the strap and the pin is then seated in the slots 31 formed in the edges of the slot 27 formed in the concave surface 23. The strap is then pulled tight under the first cross-brace to seat the pin. In effect, the end of the strap is fed under the first cross-brace and wrapped around the second cross-brace or pin and direction reversed and fed back under the first cross-brace and then clamped to that portion of the strap extending between the backpack and the actuator by being trapped between the tank and the strap. As a result, the length of the end of the strap which is secured to the actuator can be adjusted by loosening the strap and pulling it one way or the other around the second cross-brace or pin.

In the preferred embodiment, a strengthening means has been included in the first cross-brace 25 to provide additional strength and integrity to the structure of the actuator body portion 21 due to the large tension forces that can develop in the strap 13. In particular, the first cross-brace bridging the slot 27 is provided with a retaining recess 33 for insertion of a steel rod 35 which extends the length of the cross-brace and between the edges of the concave surface 23. This design permits the strap to be disposed in the slot 27 underneath the cross-brace 25 formed at the end of the body portion and around a retaining pin 29 at the end of the strap. When the actuator tightens the strap 13 around the tank 11 the second cross-brace or retaining pin 57 and the strengthening rod 35 are urged into their recesses 31, 33 in the actuator body by the tightening action against the tank.

A movable block 37 forming a partial wedge is mounted on the body portion 21 and is formed to reciprocate along a pair of tracks 39 on a flat surface 41 disposed on the opposite side of the body portion from the concave surface 23. In the preferred embodiment, the tracks are simply side rails formed along both edges of the flat surface. The wedge block is secured to one end of a connecting rod 43 the other end of which is secured to a piston 45 disposed in an expandable air cylinder 47 whereby movement of the piston in the cylinder reciprocates the connecting rod and thereby the attached wedge block along the tracks bracketing the flat surface. The wedge block has a strap engaging or guide surface 49 along which the strap 13 slides when the wedge is actuated. The edges of the wedge block guide surface are also provided with side rails 51 to guide and contain the strap to prevent it from sliding laterally on the wedge block guide surface. The strap pressure on the wedge block holds it in the tracks 39.

It would be obvious to reverse the mode of operation by securing one end of the strap to the body portion and the other end to the movable block and to pull on the ends of the strap to tighten it around the air tank. Such an embodiment is contemplated as part of the present invention. However, the preferred embodiment utilizes the strap to encircle the actuator mechanism which holds the mechanism together, and as a result it is considered less likely to come apart in operations whereby a malfunction during use may be less catastrophic.

A second strap engaging means is provided for securing the other end 17 of the strap 13 to the body portion 21. The second strap engaging means is disposed on the body portion at a position closer to the first strap securing means than the movable wedge block 37. In other words, the second strap engaging means is disposed on the body portion between the first strap securing means and the wedge block whereby movement of the wedge block away from the two strap engaging means forces the strap outward from the air tank 11 thereby tightening the strap and forcing the air tank against the diver's backpack.

Figure 4:
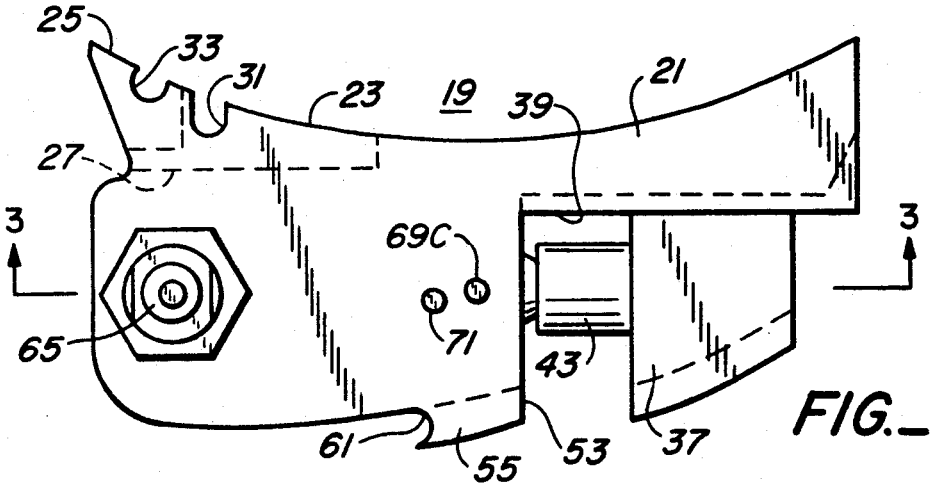
FIG. 4 is a top plan view of the tank strap tightening actuator body portion of the present invention with the wedge block in extended position.
Figure 4A:
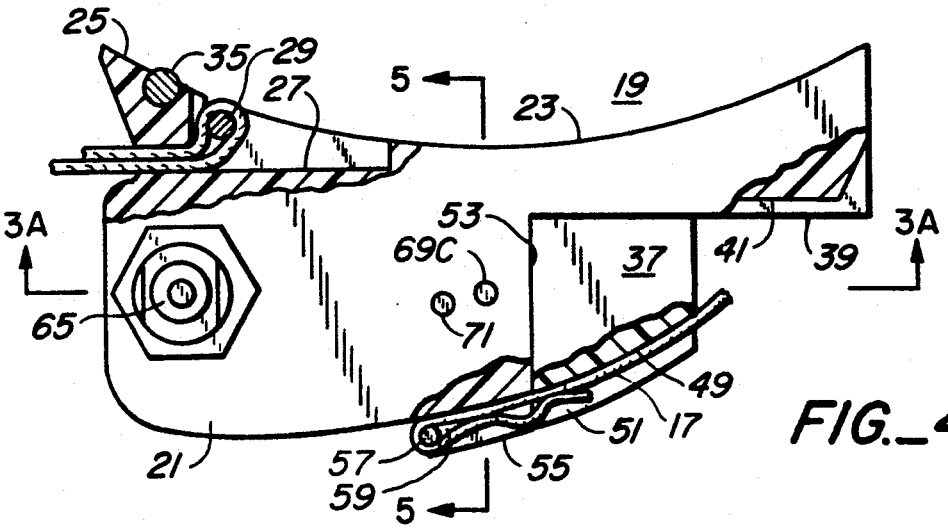
FIG. 4A is the top plan view of FIG. 4 partly broken out in section and the wedge block in retracted position.
Figure 2A:
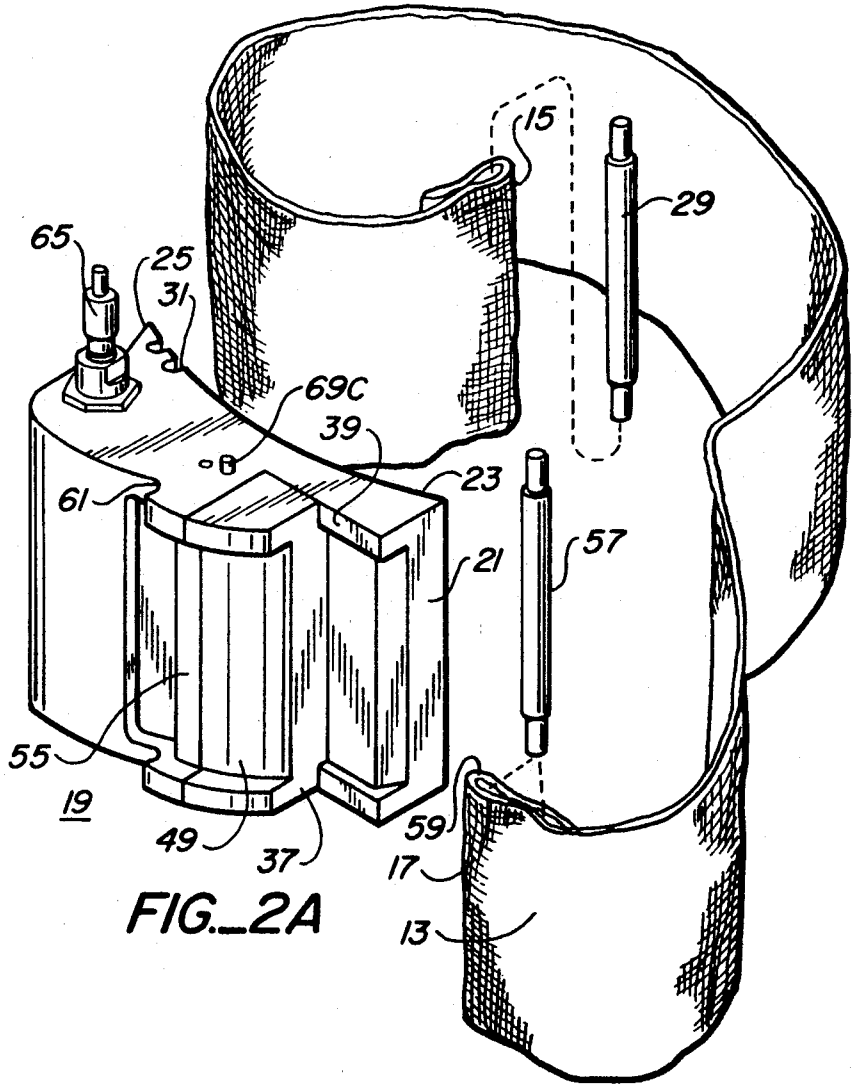
FIG. 2 is a close up perspective view showing the SCUBA tank strap tightening actuator with the ends of the strap secured to the actuator and the actuator mechanism in operative extended position for tightening the strap around the tank.
Figure 2:
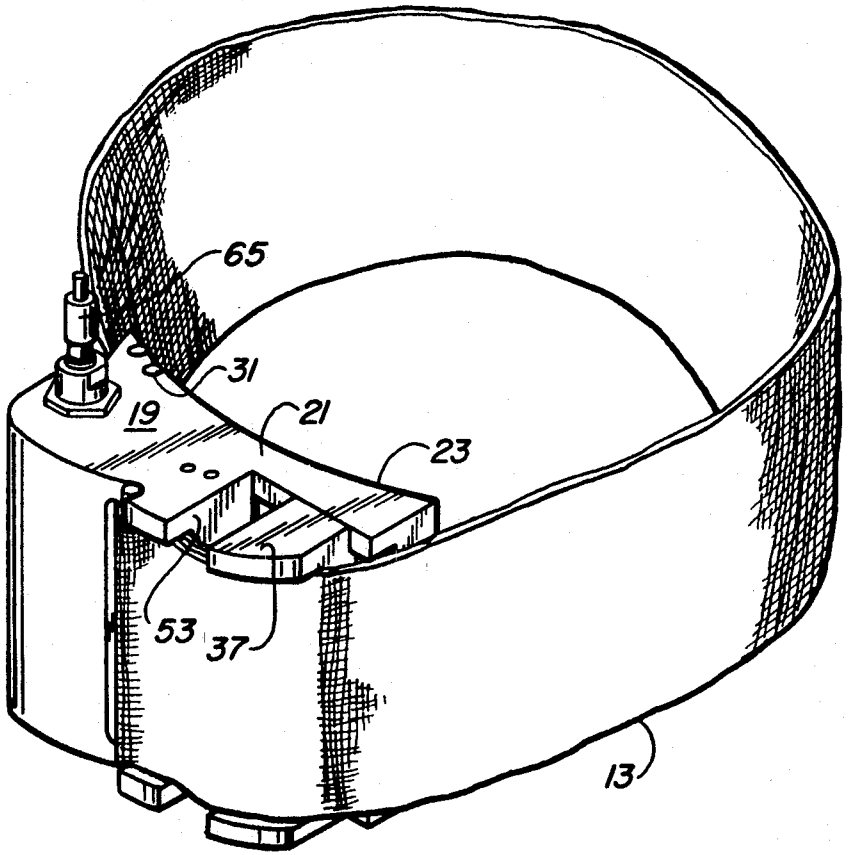

Reference is made to FIGS. 2 and 4 for illustrations of the collapsed and extended positions of the wedge block 37. FIGS. 2A and 4A show the wedge block in its retracted position on its tracks 39 on the body portion 21 and seated against a mating surface 53 also formed on the body portion disposed proximate to the second strap engaging means. FIGS. 2 and 4 show the wedge block riding the tracks, and a recessed trough between the tracks, on the outer surface of the body portion on the opposite side from the concave surface 23. The strap engaging or guide surface 49 on the face of the wedge block, and the adjacent surface 55 of the body portion contiguous to the mating surfaces, have a convex curved surface forming the wedge effect of the wedge block. This permits the wedge block to slide under the tank strap 13 and tighten the strap against the tank 11.

When the wedge block 37 is actuated, it moves to the right in FIG. 4 to expand the circumference the strap 13 must extend around and thereby tightens the strap which forces the air tank 11 against the backpack of the SCUBA diver. Very little actuation displacement or movement of the wedge is required to increase the length of the circumference around which the strap must extend due to the relatively small circumference of the air tank. In other words, the strap is pushed away from the tank surface a proportionately significant distance by small movement of the wedge block.

The second strap engaging means includes a stainless steel rod or pin 57 which is inserted into a permanent loop 59 sewn into the end 17 of the strap. Actually, two adjacent loops are sewn into the end of the strap for quick length adjustment whereby the other end 15 does not need to be readjusted if the strap stretches slightly when it gets wet. The pin can just be shifted to the next loop. The pin has the two projecting ends which extend from the loop whereby they can engage notches 61 formed in the side rails 51 of the actuator body portion. When tension is applied to the strap, the ends of the pin are pulled into the notches which are reverse angled whereby the pin is locked therein until the tension is released allowing the pin to be disengaged from the notches and thereby the end of the strap from the second engagement means of the actuator.

Figure 3:
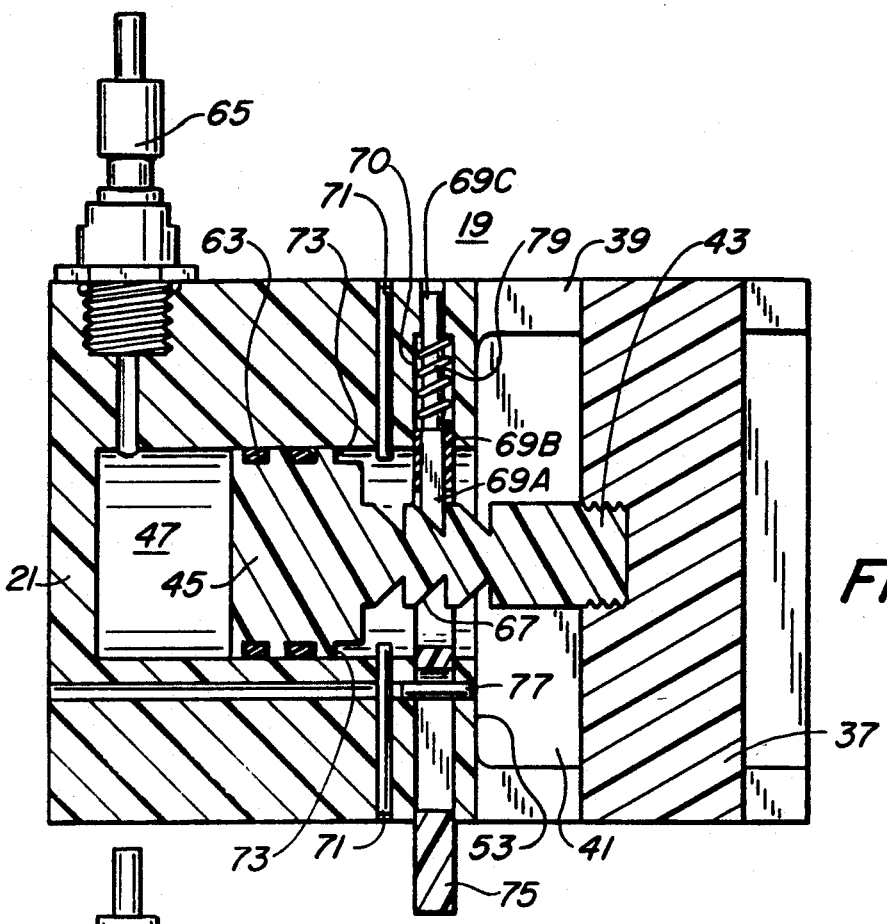
FIG. 3 is a cross-section view taken along lines 3—3 of FIG. 4 showing the actuator mechanism in extended position for tightening the strap and with the safety locks engaged.
Figure 3A:
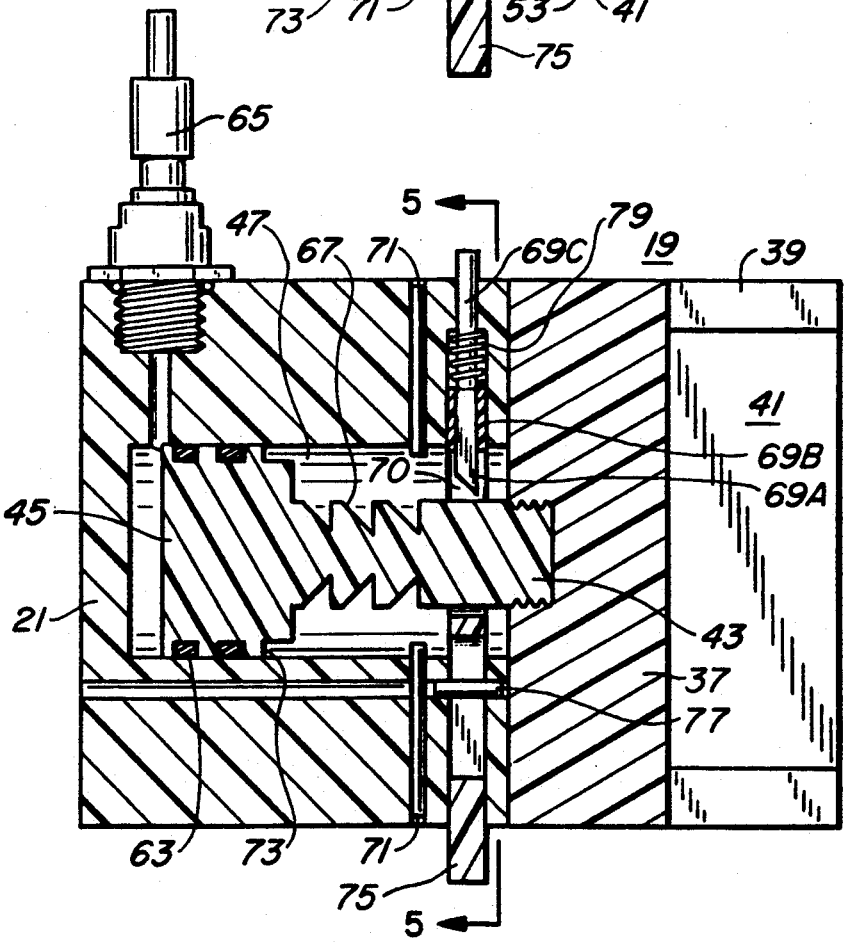
FIG. 3A is a section view taken along lines 3A—3A of FIG. 4 showing the wedge block in retracted position with the safety locks disengaged.

Reference is made to FIG. 3 for an understanding of the operation of the actuator expansion mechanism. The body portion 21 is provided with an internal cylinder 47 which has a piston 45 that moves therein due to air pressure. Sealing rings 63 are provided to contain compressed air which is introduced into the cylinder through a modified Shrader valve 65 (tire air valve) common to dive equipment. It includes a cap and actuator pin which causes the air hose from the tank to release air into the Shrader valve. The piston connecting rod 43 which is engaged with the wedge block 37 is provided with ramped locking steps 67 whereby as the piston is extended, a spring-loaded locking pin 69 engages the steps successively until the maximum extension of the wedge is achieved. The locking pin is a integral unit having a spade engagement portion 69A which engages the ramped locking steps 67 of the wedge block, a guide portion 69B which slides in the guide slot 70 formed in the body portion, and a spring guide pin 69C. The spring-loaded locking pin is forced into each ramped locking step in succession permitting only expansion movement until the last step engaged by the locking pin holds the wedge/rod/piston assembly at the extent of its expansive movement.

Limit stop pins 71 are also provided to prevent the piston 45 from overextending its movement due to excess air pressure or lack of resistance to movement of the wedge block. These pins are likewise inserted into the body portion 21 of the actuator and engage a predetermined leading edge 73 of the piston to limit its extension movement.

A lock release 75 is provided on the opposite side of the body portion to release the spring-loaded locking pin 69 when it is necessary to release the strap tension. The lock release is a tab which pushes the locking pin 69 out of its engagement with the ramped locking steps 67 when the tab is actuated against the spring pressure 79 of the locking pin by pushing the pin into the opposite side of the body portion of the actuator. A guide pin 77 prevents the tab 75 from falling out of the actuator body.

In operation, the free end 17 of the strap with the steel pin 57 is hooked into the engagement notches 61 whereby the strap 13 engages with the body portion 21. Air pressure from the tank is then applied to the Shrader valve 65 which causes the wedge block 37 to extend as shown in FIGS. 2, 3 and 4. When the wedge block is extended as far as it will go, the locking pin 69 is automatically pushed into locking position by the spring 79 to prevent the connecting rod 43 from reversing direction and thereby the wedge block from retracting when the air pressure is removed from the Shrader valve. Even though the Shrader valve will not release air, there is a momentary release of air pressure during disconnect which might permit the piston to move back and the locking pins prevent this from occurring or retraction in the event of failure of the Shrader valve, but the locking pins are mainly to prevent movement of the wedge block in the event air pressure is lost from the chamber, although in normal operation it is not. In fact, as the strap stretches when it gets wet, the air pressure in the cylinder further actuates the wedge block to keep the constant tension in the strap. In order to release the strap, it is necessary to first press the locking pin 69 out of position by means of the actuation tab 75 and thereafter release the air pressure through the Shrader valve by means of depressing the air release stem.

Thus, it will be apparent from the foregoing description of the invention, in its preferred form, that it will fulfill all the objects and advantages attributable thereto. While it is illustrated and described in considerable detail herein, the invention is not to be limited to such details as have been set forth except as may be necessitated by the appended claims.

We claim:

1. A tank strap tightening actuator for securing a SCUBA air tank to a diver's backpack by means of a flexible strap which engages the backpack and surrounds the tank with the ends of the strap being hooked to said actuator around said tank, said actuator comprising a body portion having a concave surface formed for mating with the surface of an air tank, a first means on said body portion for engaging said strap proximate to one end thereof, a movable block mounted on said body portion and formed to reciprocate along a surface disposed on the opposite side of said body portion from said concave surface, a second strap engaging means for securing the other end of said strap to said body portion at a position relative to said movable block whereby movement thereof tightens the strap around the air tank and against the diver's backpack, and actuation means on said body portion for moving said block until the strap is tightened.

2. The tank strap tightening actuator of claim 1 wherein said actuation means is an air cylinder connected to said movable block which can be actuated by compressed air from the air tank.

3. The tank strap tightening actuator of claim 2 wherein said movable block is a partial wedge and the second strap engaging means secures the other end of said strap to said body portion at a position closer to said first strap engaging means than said movable wedge block whereby the actuation means moves said wedge block away from said first and second strap engaging means and forces the strap outward from said air tank to increase the circumference the strap must encircle thereby tightening the strap around the air tank.

4. The tank strap tightening actuator of claim 3 wherein said second engagement means is a cross piece which releasably engages said actuator.

5. The tank strap tightening actuator of claim 4 wherein the releasable engagement means includes receptive fittings on said body portion which engages said cross piece and prevents tension from pulling the cross piece out of the receptive fittings but essentially releases said cross piece when the tension is removed from the strap.

6. A tank strap tightening actuator for securing a SCUBA air tank to a diver's backpack by means of a strap which engages the backpack and surrounds the tank with the ends of the strap being hooked to said actuator around said tank, said actuator comprising a body portion having a concave surface formed along one side thereof for mating with the surface of an air tank, a first means on said body portion for engaging said strap proximate to a first end thereof, a movable wedge block mounted on said body portion and formed to reciprocate along a surface disposed on the opposite side of said body portion from said concave surface, said wedge block being actuated by compressed air, and a second strap engaging means for securing the other end of said strap to said body portion at a position closer to said first strap engaging means than said movable wedge block whereby actuation of said wedge block away from said first and second strap engaging means forces the strap outward from said air tank to increase the circumference the strap must encircle thereby tightening the strap around the air tank and against the diver's backpack, said second engagement means including a cross piece secured to the first end of said strap which releasably engages said actuator, said releasable engagement means including receptive fittings on said actuation mechanism which engages said cross piece and prevents tension from pulling the cross piece out of the receptive fittings but essentially releases said cross piece when the tension is removed from the strap.

* * * * *